United States Patent [19]

Earnhardt

[11] 4,007,829

[45] Feb. 15, 1977

[54] SAFETY MATCH PACK

[76] Inventor: Danny W. Earnhardt, Rte. 7, Box 32, Hickory, N.C. 28601

[22] Filed: Nov. 13, 1975

[21] Appl. No.: 631,645

[52] U.S. Cl. ..... 206/108; 206/98

[51] Int. Cl.[2] ..... A24F 77/00

[58] Field of Search ..... 206/106–115, 206/98–100

[56] References Cited

UNITED STATES PATENTS

| | | | |
|---|---|---|---|
| 1,724,712 | 8/1929 | Hough | 206/108 |
| 1,849,432 | 3/1932 | Moriya | 206/109 |
| 1,853,279 | 4/1932 | Lonkowski | 206/107 |
| 2,126,015 | 8/1938 | Howland | 206/109 |
| 2,217,854 | 10/1940 | Baldwin | 206/109 |
| 3,966,041 | 6/1976 | Burgess et al. | 206/108 |
| 3,967,725 | 7/1976 | Thompson | 206/108 |

*Primary Examiner*—William Price
*Assistant Examiner*—Douglas B. Farrow
*Attorney, Agent, or Firm*—Roy B. Moffitt

[57] ABSTRACT

In the match pack of this invention, the ignition or striking surface is positioned on an interior wall surface of the ignition chamber which is conveniently located on the bottom portion of the match pack below the match comb or combs in the match pack. The housing or body structure defining the ignition chamber is formed with at least one entry hole or passage which opens into the ignition chamber to enable a match to be inserted into the chamber for ignition. An ignition finger conveniently positioned on the closure flap or front cover of the match pack is insertable through a slot in the chamber-defining body structure to press the match head of the inserted match against the striking or ignition surface and to thereby facilitate ignition of the match upon rapidly withdrawing it from the ignition chamber.

7 Claims, 17 Drawing Figures

FIG. 4
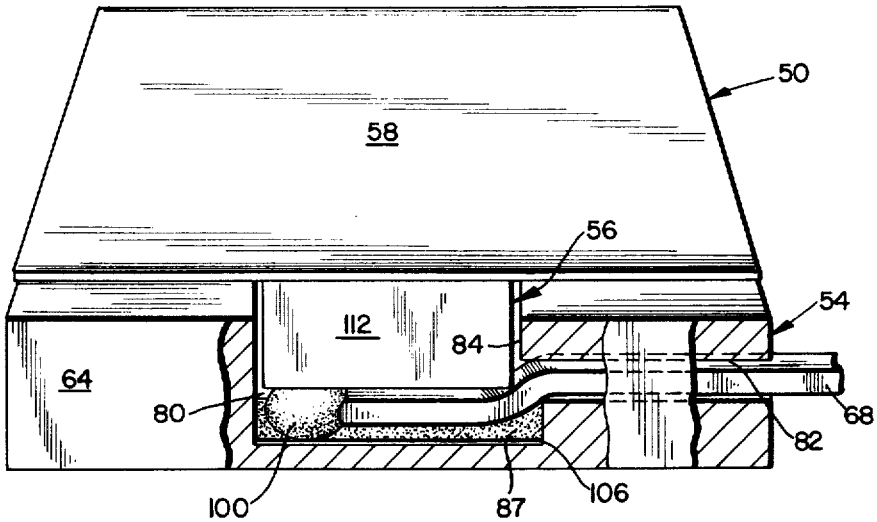
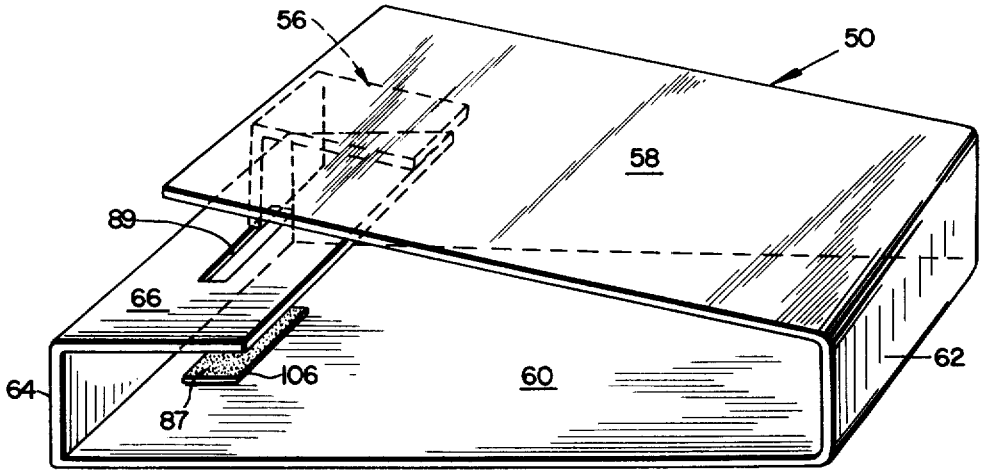
FIG. 5
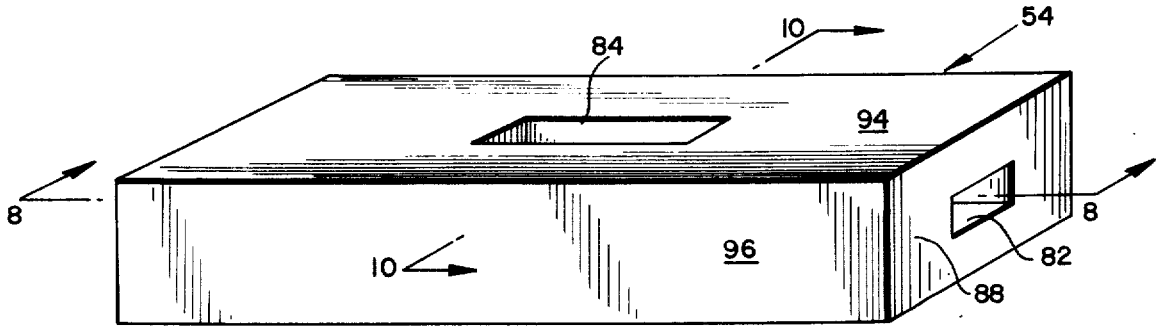
FIG. 6

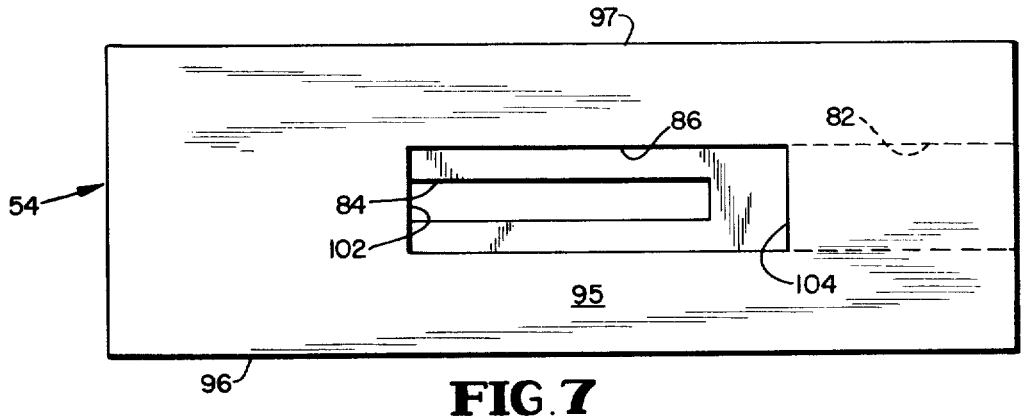
FIG. 7
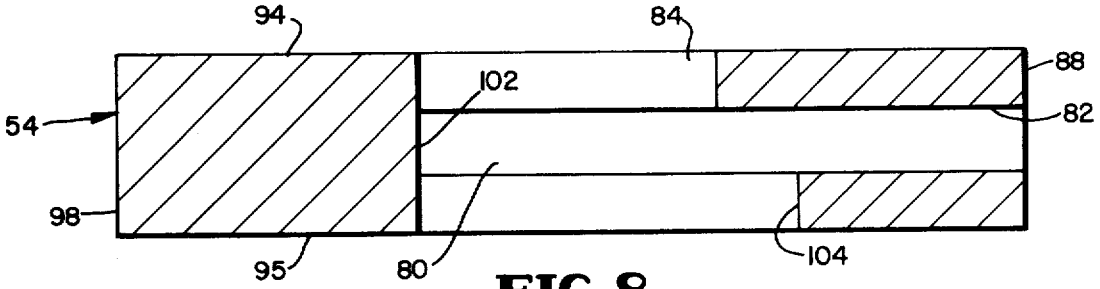
FIG. 8
FIG. 10
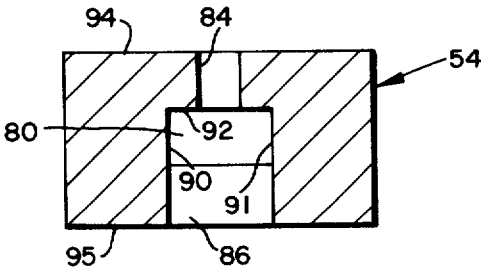
FIG. 9
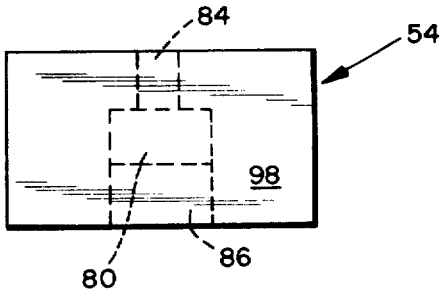

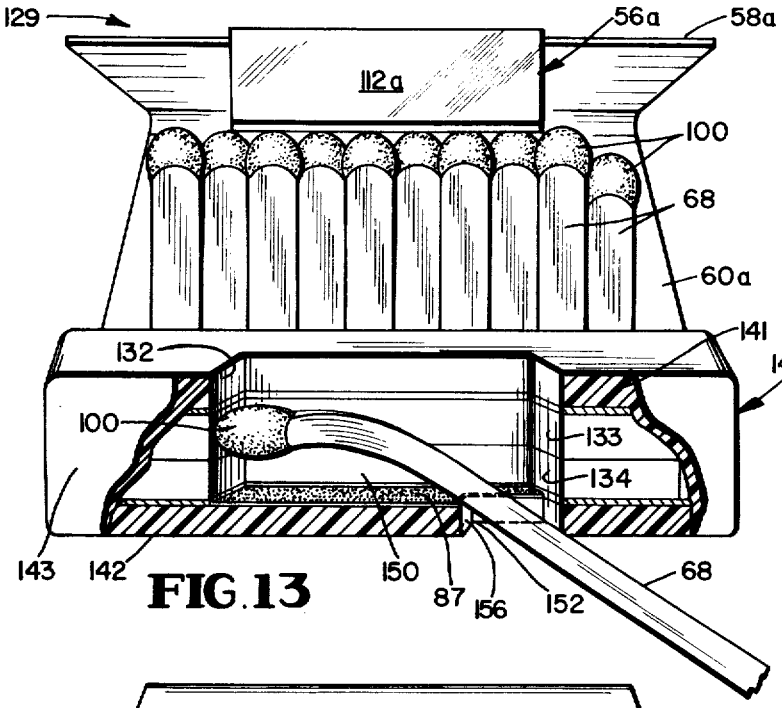
FIG. 13
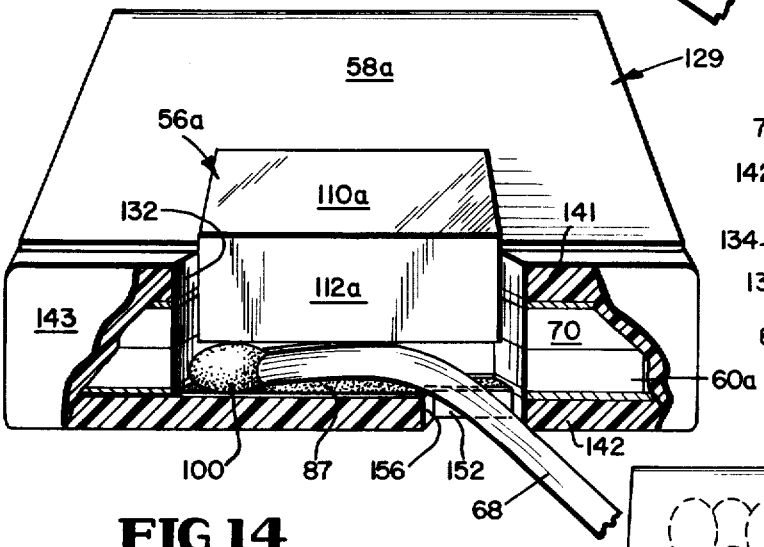
FIG. 14
FIG. 15
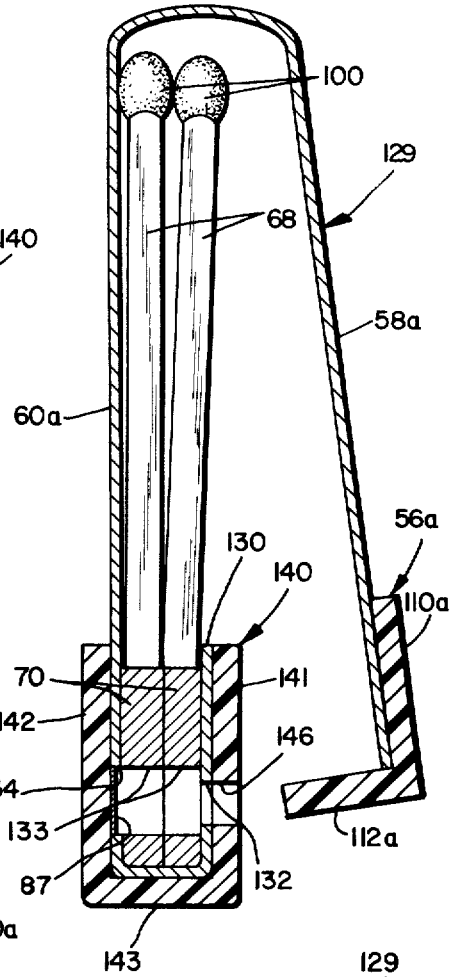
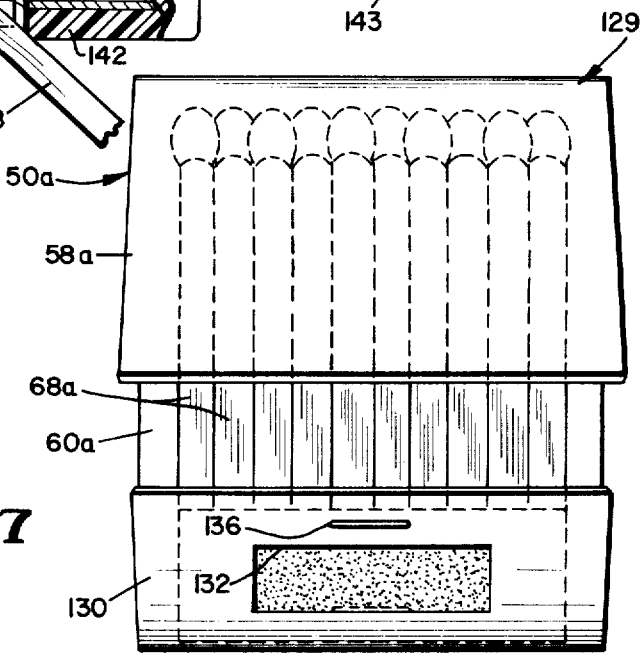
FIG. 17

SAFETY MATCH PACK

FIELD OF THE INVENTION

This invention relates to book-type match packs or packages.

BACKGROUND

Conventional safety match packs are typically constructed with a cover envelope to provide protection against ignition of matches remaining in the pack by the ignition of a removed match on a phosphorus ignition surface which is usually located on the retaining flap of the match pack cover. In some conventional match pack constructions the ignition surface, instead of being located on the retaining flap, is positioned on the bottom portion of the front cover flap which is relatively flexible in its open position to make it difficult to ignite a match when the cover flap is in an open position. Because of the relatively small amount of pressure required to ignite a match, however, ignition can still be accomplished without closing the cover flap. This safety measure therefore does not provide an adequate safeguard against injury or damage.

Various safety measures have been heretofore proposed for safety match packs to improve protection against injury or damage. Examples of such measures are described in U.S. Pat. No. 2,102,580 issued to R. F. Mahon on Dec. 14, 1937, U.S. Pat. No. 2,105,141 issued to H. B. Eastman on Jan. 11, 1938, U.S. Pat. No. 2,118,726 issued to E. D. Edwards on May 24, 1938, U.S. Pat. No. 2,277,021 issued to H. F. Swain on Mar. 17, 1942, U.S. Pat. No. 2,620,920 issued to C. Hill on Dec. 9, 1952, and U.S. Pat. No. 3,690,449 issued to M. Seldin on Sept. 12, 1972.

None of the match book constructions disclosed in the foregoing patents provides a combination of three major, very important safety features described below.

The most important of these three safety features is protection of small children from burns inflicted while playing with matches. Any of the foregoing prior constructions permit a small child to ignite a match mainly because the matches and the ignition surface are exposed and easily accessible.

The second safety feature is protection against an explosive type of ignition or burning of the match rather than a slow and even burning of the match. Such an explosive type ignition or burning is usually caused, when for one reason or another, the matches become wet or damp at some time and then dry leaving the match heads brittle. The irregular or explosive-like burning usually takes place at the initial ignition phase of combustion when a person using the match pack just begins to draw the match head across the ignition surface. Under such conditions persons are frequently burned by flaming particles flying from the match head. Additionally, damage to clothing or other nearby objects frequently occurs under such conditions.

The third safety feature which prior art constructions usually address is to keep the balance of the matches in the pack from igniting accidentally when a purposeful ignition of a removed match is being carried out.

Prior to this invention, no known safety match pack incorporated a combination of foregoing safety features described above. Hence, known prior art match packs demonstrate a desperate need for a match pack which alleviates the dangerous conditions mentioned above.

SUMMARY AND OBJECTS OF INVENTION

With the foregoing in mind, a major object of this invention is to provide a novel safety match pack which incorporates all three of the safety features mentioned above.

This object is accomplished by a novel construction which encloses the striking or ignition surface in an ignition chamber so that it is not exposed as in prior art constructions, which additionally require the closing of the closure flap or front cover of the cover envelope in order to ignite a match, and which also requires a multiplicity of manipulative steps to effect ignition of a match removed from the pack.

In the match pack of this invention, the ignition or striking surface is positioned on an interior wall surface of the ignition chamber which is conveniently located on the bottom portion of the match pack below the match comb or combs in the match pack. The housing or body structure defining the ignition chamber is formed with at least one entry hole or passage which opens into the ignition chamber to enable a match to be inserted into the chamber for ignition. An ignition finger conveniently positioned on the closure flap or front cover of the match pack is insertable through a slot in the chamber-defining body structure to press the match head of the inserted match against the striking or ignition surface and to thereby facilitate ignition of the match upon rapidly withdrawing it from the ignition chamber.

The walls of the ignition chamber confine any sparks or flaming particles resulting from irregular ignition or burning to protect the user and also to provide protection against burning of the user's clothing or other objects. Additionally, the striking or ignition surface is not exposed and is not positioned on an exterior surface of the match pack where it would be easily accessible for the purpose of igniting a match taken from the pack or from some other source.

Furthermore, the ignition or striking surface and the entry hole mentioned above are located in such a manner that the match head upon insertion into the ignition chamber is spaced from the ignition surface prior to insertion of the ignition finger into the ignition chamber by closing the closure flap or front cover. The ignition chamber housing or body structure is constructed in such a manner that the match can only be inserted into the ignition chamber through the entry hole. With this construction, therefore, the match head cannot contact the ignition surface for ignition without first closing the front cover after the match has been inserted into the ignition chamber through the entry hole.

Accordingly, the user is fully protected. Additionally, the balance of the matches in the match pack are protected against accidental ignition not only by confining ignition of the match in the ignition chamber but also by requiring the closure of the front cover before ignition can be effected.

In the match pack of this invention, the match can only be inserted into the ignition chamber before the ignition finger is inserted into the chamber. Thus upon removing a match from the pack, it must be first inserted into the ignition chamber only through the entry hole before the front cover is closed. Then, with the match head in the ignition chamber the front cover must be closed to insert the ignition finger to a position where it presses the match head against the striking surface. Finally, to effect ignition, the match must be withdrawn rapidly from the ignition chamber with one hand while applying moderate pressure to the ignition finger with the other hand. This series of manipulative steps is exceedingly difficult for a small child to master, thus making the match pack of this invention virtually child-proof.

In addition to meeting the foregoing safety requirements, the match pack of this invention is relatively simple in construction and inexpensive to manufacture. Additionally, its size and dimensions may be comparable to existing conventional match packs to facilitate its use in existing vending and packaging machines.

The ignition finger mentioned above performs an additional function in the match pack of this invention in that it acts as a keeper or latch to retain the front cover in its closed position.

Accordingly, a further object of this invention is to provide a novel safety match pack in which the ignition or striking surface is not positioned on an exterior surface of the pack, but instead is positioned in a ignition chamber into which a match to be ignited must be inserted to effect ignition of a match.

A further object of this invention is to provide a novel safety match pack in which the match head of a removed match cannot be brought into contact with the striking surface except by inserting the match head into an ignition chamber and by closing the closure flap or front cover of the cover envelope.

Still a further object of this invention is to provide a novel safety match pack which has an ignition chamber in which ignition of a removed match takes place to protect the user against injury and also to protect the user's clothing or other objects against damage.

Still a further important object of this invention is to provide a safety match pack which requires a series of manipulative steps which are exceedingly difficult for a small child to master in order to prevent the child from igniting a match with the match pack.

Still a further object of this invention is to provide a novel safety match pack which prohibits ignition of a match removed from the pack except by closing the front cover.

Another important object of this invention is to provide a novel safety match pack which not only incorporates the three safety features mentioned above, but which also is inexpensive to manufacture and which can be made in a size comparable to existing conventional safety match packs.

These and other objects will appear as the description proceeds in connection with the below-described drawings and the appended claims.

DESCRIPTION OF DRAWINGS

FIG. 4 is a perspective view similar to FIG. 3, but showing the closure flap closed to press the head of the inserted match against the interior striking or ignition surface within the ignition chamber;

FIG. 5 is a generally perspective view of the match pack shown in FIG. 1, but with the ignition chamber body and the match comb removed to more clearly illustrate the construction of the cover envelope assembly which comprises the cover envelope itself, the ignition finger and the striking surface;

FIG. 6 is a generally perspective view of the ignition chamber body shown in the previous Figures;

FIG. 7 is a bottom plan view of the ignition chamber body shown in FIG. 6;

FIG. 8 is a section taken substantially along lines 8—8 of FIG. 6;

FIG. 9 is a left-hand end view of the ignition chamber body shown in FIG. 6;

FIG. 10 is a section taken substantially along lines 10—10 of FIG. 6;

FIG. 13 is a perspective view similar to FIG. 3 and showing a match inserted into the ignition chamber with the front cover or closure flap in its open position;

FIG. 14 is a generally perspective view similar to FIG. 13, but showing the front cover in its closed position to press the match head of the inserted match against the interior striking surface;

FIG. 15 is a section taken substantially along lines 15—15 of FIG. 11;

FIG. 17 is a generally perspective view of the match pack shown in FIG. 11, but with the ignition chamber member removed to illustrate details of the match pack.

DETAILED DESCRIPTION

Figure 1:
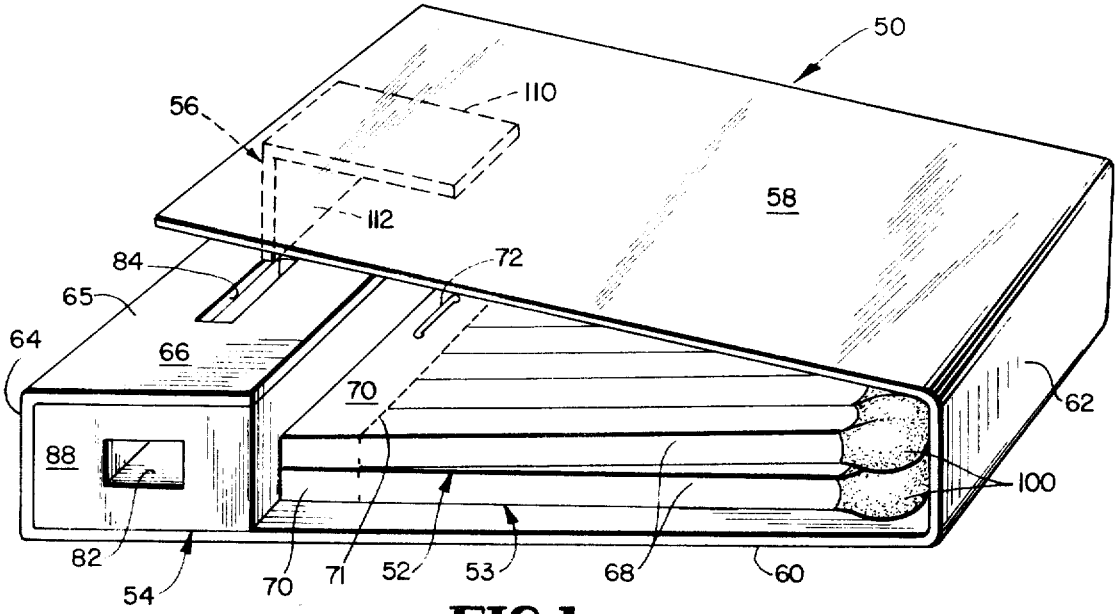
FIG. 1 is a generally perspective view of one embodiment of a safety match pack incorporating the principles of this invention.

Referring to FIGS. 1–4, one embodiment of a book type safety match pack incorporating the principles of this invention is shown to comprise a match pack cover envelope or jacket 50, a pair of match combs 52 and 53, an ignition chamber body 54, and an ignition finger or member 56.

The match pack cover envelope may be formed from a single sheet of cardbord or other suitable material and has the usual relatively foldable front and back cover portions. The front cover or front closure flap is indicated at 58, and the back cover or back cover section is indicated at 60.

As shown, front cover 58 is integrally joined to the back cover section 60 by a narrow top wall 62. In this embodiment back cover 60 terminates in a retaining flap portion 66 which is folded to define a bottom wall portion 64 and a front wall portion 65.

Each of the match combs 52 and 53 may be of any suitable, conventional construction having a row of matches 68 extending from a base 70. Perforations 71 are provided at the regions where the stems of matches 68 join to their bases 70 to permit the matches to be torn out of the book in the usual fashion.

Instead of being sandwiched between retaining flap 66 and back cover 60 in the usual way, the bases of match combs 52 and 53 are spaced from bottom wall 64 as shown to permit the ignition chamber body 54 to be positioned between bottom wall 64 and the bottom edges of bases 70. Match combs 52 and 53 are stapled or other suitably secured directly to the inside face of back cover 60 as indicated at 72. When the front cover 58 is closed, match combs 52 and 53 are therefore confined between the front and back covers. The bottom edges of bases 70 may be flush with (i.e. directly abutting or immediately adjacent to) the top wall surface of body 54 as shown.

Figure 2:
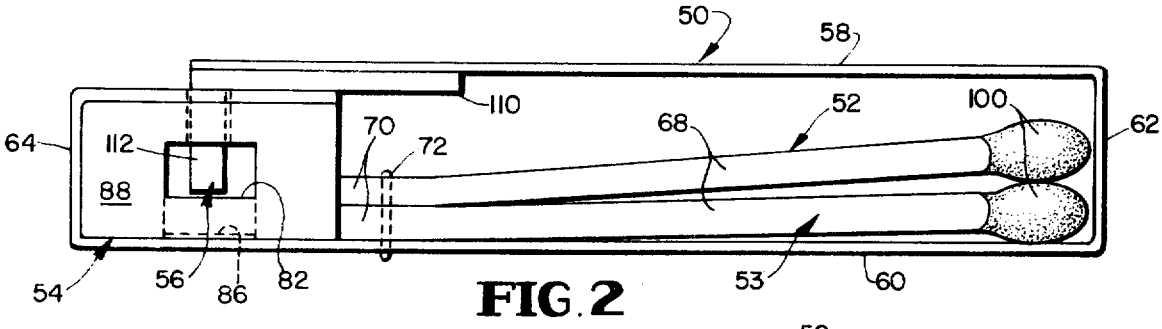
FIG. 2 is a right-hand side elevation of the safety match pack shown in FIG. 1.

As shown in FIGS. 1 and 2, retaining flap 66 and back cover 60 define a generally U-shaped channel which receives the ignition chamber body 54. Retaining flap 66 is folded over onto the front face of body 54 so that body 54 is sandwiched between the front wall portion 65 of flap 66 and the cover's back side or back cover portion 60 as shown. Body 54 is rigidly fixed to the back cover portion 60 and flap 66 by suitable means such as adhesive. Flap 66 thus performs a function of retaining body 54 in place and is not employed to retain match combs 52 and 53.

The ignition chamber body 54 may be formed from any suitable material which preferably provides rigid or relatively stiff body structure. For example, body 54 may be molded as one piece from a plastics material as shown in FIGS. 1–4 and 6–10. Alternatively, body 54 may be formed from chipboard or cardboard.

As best shown in FIGS. 6–10, body 54 has a flat-sided rectangular block-like configuration and is interiorally formed with an ignition chamber 80 for safely igniting a match taken from the match book. The exterior wall surfaces of body 54 may be flat as shown.

Body 54 is additionally formed with a match-insertion passage or entry hole 82, an ignition finger slot 84 and an ignition surface slot 86. Passage 82 is adapted to receive a match to be ignited. Slot 84 is adapted to receive the ignition finger 54 to hold the match against a phosphorus striking or ignition surface 87 which is located in registry wih slot 86. Retaining flap portion 66 is formed with a rectangular slot 89 which is in alignment and registry with slot 84 to permit entry of finger 56 into slot 84.

As shown, passage 82 is straight and rectangular in configuration in this embodiment, extends inwardly from the right-hand end face 88 of body 54 and opens at its inner end into chamber 80. Thus, passage 82 terminates at its inner end in chamber 80, and the chamber's interior side wall surfaces 90 and 91 and top wall surface 92 (see FIG. 10) are preferably smooth uninterrupted continuations of the flat, internal side and top wall surfaces of passage 82. With this construction, therefore, the width of chamber 80 as viewed from FIG. 10 is equal to the width of passage 82, and the height of chamber 80 is at least as great as that of passage 82. Passage 82 is disposed about midway between the top and bottom exterior wall surfaces 94 and 95 of body 54 and about midway between the body's exterior front and back wall surfaces 96 and 97.

As shown in FIGS. 6-10, slot 84 has a straight-sided, rectangular configuration and is elongated in the direction of passage 82 and chamber 80. Slot 84 is located about midway between end wall surfaces 88 and 98 and about midway between the front and back wall surfaces 96 and 97 in registry with chamber 80. As shown, slot 84 is formed in the top wall surface 85 of body 54 and opens into chamber 80 through the chamber's internal top wall 92. Slot 84 is additionally located midway between the ignition chamber wall surfaces 90 and 91 to locate or position ignition finger 56 centrally in chamber 80 when it is inserted into the ignition chamber through slot 84.

Slot 84 is deliberately made much narrower than the width or thickness of the match head (indicated at 100 in FIGS. 1 and 2) to prevent the match from being inserted through slot 84 for striking against or contact with the ignition surface 87. Preferably, the length of slot 84 is about one-third of the length of the length of the match being used. The width of slot 84 is preferably at least 1/16th of an inch.

Slot 86 is formed in wall surface 95 and extends inwardly to open into the central region of chamber 80. Slot 86 defines the lower region of chamber 80.

As shown, slot 86 has a rectangular straight-sided configuration and is elongated in the direction of chamber 80, passage 82 and slot 84. Slot 86 is located about midway between wall surfaces 96 and 97. Slot 86 aligns with and has the same width as the central region of chamber 80 as viewed from FIG. 10.

As shown, smooth uninterrupted continuations of the interior wall surfaces 90 and 91 define the internal side wall surfaces of slot 86. Therefore, wall surfaces 90 and 91 define the interior side walls of both slot 86 and the central region of chamber 80.

The left hand interior end wall surfaces of slots 84 and 86 and chamber 80, as viewed from FIGS. 7 and 8, are defined by a single internal flat wall surface 102 which extends perpendicularly between the top and bottom wall surfaces 94 and 95 of body 54. As shown, slot 86 is longer than slot 84 for a purpose to be described later on.

From the foregoing construction, it will be appreciated that the central region of chamber 80, which aligns with and constitutes a continuation of passage 82, is disposed between slots 84 and 86. Slot 84 is in registry with slot 86 as well as the central region of chamber 80 as shown. Chamber 80 is rectangular in cross section.

Figure 3:
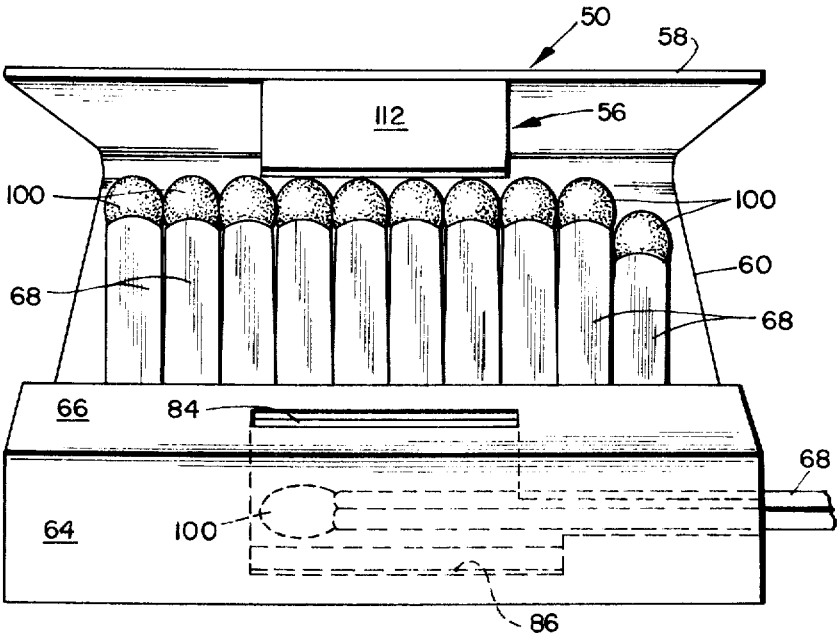
FIG. 3 is a generally perspective view as seen from the bottom edge of the match pack of FIG. 1 in which a match to be ignited is shown to be inserted into the ignition chamber with the closure flap or front cover in its open position.
Figure 11:
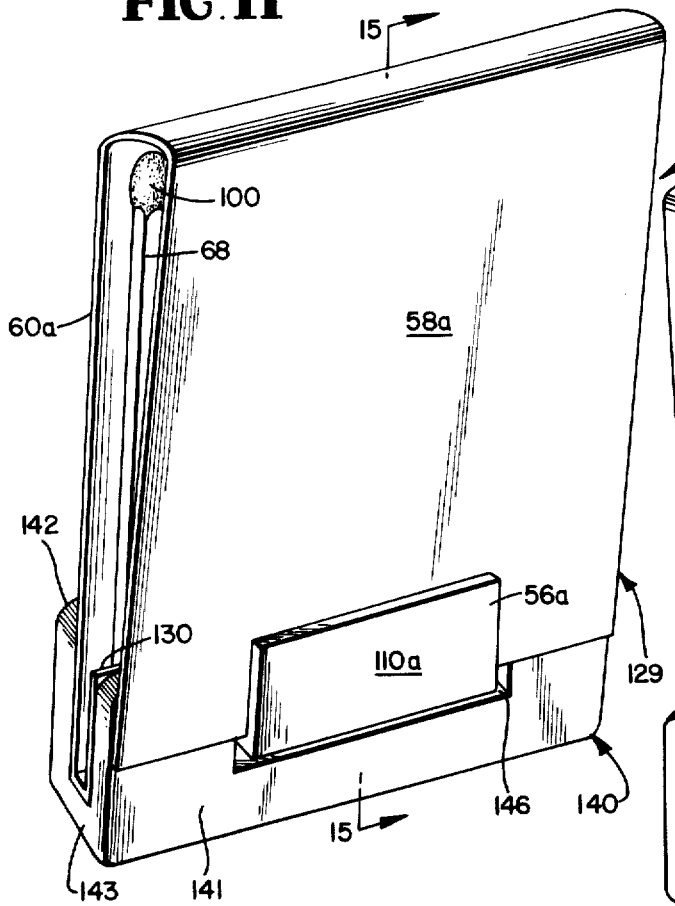
FIG. 11 is a generally perspective front view of a match pack constructed according to another embodiment of this invention.
Figure 12:
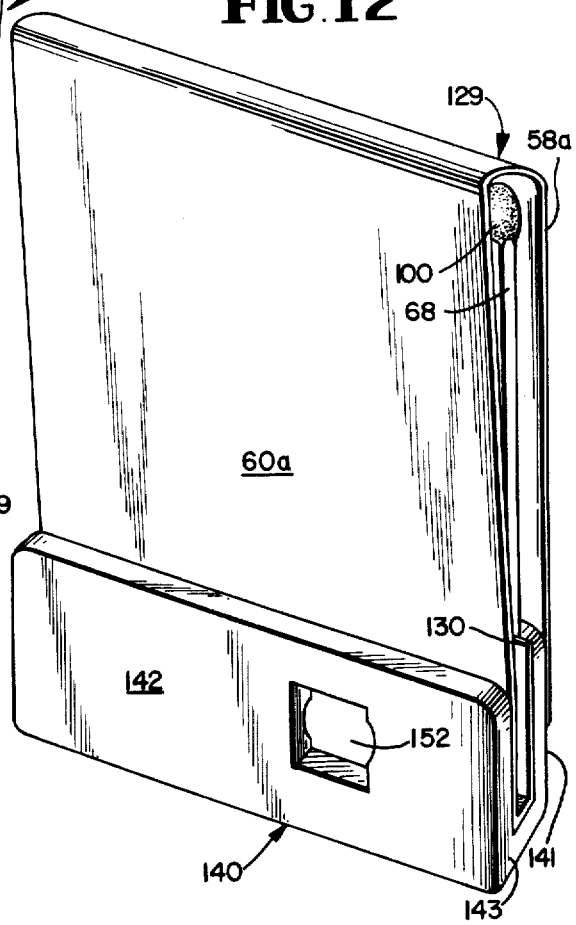
FIG. 12 is a generally perspective back view of the safety match pack shown in FIG. 11.

As shown in FIGS. 2–4, the wall surface 95 of body 54 seats against the inside face of back cover 60 so that the outer end of slot 86 is closed and covered by back cover 60. Back cover 60 thus defines the bottom wall of ignition chamber 80. Chamber 80 is therefore delimited by back cover 60, the side and top interior side wall surfaces 90–92 of body 54, and the right-hand end wall surface 104 of slot 86. In this embodiment, a plane extending perpendicularly of end faces 88 and 90 and medially intersecting body 54 also medially intersects passage 82, slots 84 and 86 and chamber 80.

The ignition or striking surface 87 is formed on a thin strip 106 (see FIGS. 3–5) which is fixed by an adhesive or any other suitable means to the inside face of back cover 60. Strip 106 and its ignition surface 87 may be of a suitable conventional construction for igniting a match. In this embodiment, surface 87 is rectangular in configuration and is positioned in registry with slot 86 so that it covers at least substantially the entire bottom wall surface of chamber 80.

As viewed from FIG. 10, passage 82, the central region of chamber 80 and slot 86 have a common width whose dimension is selected to be just slightly larger than the width of the match head to be used to provide a sliding fit between the match head and the interior side wall surfaces of passage 82 and chamber 80. Upon insertion of a match into passage 82, therefore, the match head 100 will be guided by the interior side wall surfaces of passage 82 and chamber 80 and will be positioned by these interior side wall surfaces so that it will be centered relative to slot 84 and to ignition finger 56 when the latter is inserted into slot 84.

The width of passage 82 (as viewed from FIG. 10) is made just large enough to prevent the match stem (which is customarily made of paper) from being bent as the match head is inserted through the passage for entry into chamber 80. The height of passage 82 is made just slightly larger than the thickness of match head 100 to provide a guiding or sliding fit rather than a tight fit that would cause bending of the match stem upon insertion of the match into the passage.

The length of the passage 82 is preferably about two-thirds the length of the match being used. Passage 82 lies parallel to wall surfaces 94 and 95 as shown.

The height or depth of slot 86, as viewed from FIG. 10, preferably corresponds to the thickness of the match head to be used. Slot 86 and ignition surface 87 each preferably has a length equal to approximately two-thirds the length of the match to be used to provide sufficient striking area in the direction of match removal for igniting the match. The distance of passage 82 between surface 104, and end face 88 (see FIG. 8), should be about one-fourth the length of the match to be used.

In this embodiment, ignition finger 56 (see FIGS. 2–5) is formed with an L-shaped configuration having a body portion 110 and a depending flat-sided match head-engaging finger portion 112. Ignition finger 56 is rigid and may be formed as one piece from a plastic material or any other suitable material. Finger 56 is fixed to the inside face of front cover 58 by any suitable means such as an adhesive between portion 110 and cover 58. Finger 56 is located so that portion 112 will align with and extend through slots 89 and 84 upon closing front cover 58 in the manner shown in FIGS. 2 and 4.

The height of slot 86 and the height of finger portion 112 are such that when cover 58 is closed the straight bottom edge of finger portion 112 seats firmly against match head 100 and presses the match head snugly against ignition surface 87 as shown in FIG. 4.

From the foregoing construction it will be observed that ignition surface 87 is confined inside chamber 80 along the bottom wall surface thereof and is recessed below the line entry of the match through passage 82 as best shown in FIG. 3. This construction makes it virtually impossible to ignite the match without first closing the front cover 58.

To ignite a match with the foregoing construction, the match, after it is removed from the pack, is inserted head first into passage 82 while cover 58 is still open, all as shown in FIG. 3. Insertion of the match continues until the match head 100 enters chamber 80 and abuts against or is closely adjacent to wall surface 102. The combined length of passage 82 and chamber 80 relative to the length of the match is such that a grippable end portion of the match stem remains outside of passage 82 when the match is inserted to the fullest extent where the match head 100 is in abutment with wall surface 102.

After full insertion of the match to position the match head 100 in chamber 80, the person using the match pack then closes cover 58 with his free hand to insert the ignition finger portion 112 through slot 86 and into chamber 80 to engage and press the match head 100 against ignition surface 87 as shown in FIG. 4. The depression of match head 100 into contact with surface 87 bends the match stem in the manner illustrated in FIG. 4. Then, holding the pack between thumb and forefinger of one hand to apply moderate pressure to the approximate center of the ignition finger, the match is rapidly withdrawn from body 54 by gripping the free, exposed end of the match stem and pulling the match outwardly.

With the pressure exerted through the ignition finger to press the match head against ignition surface 87, ignition of the match occurs due to the friction created upon sliding match head 100 along the ignition surface. For left-handed persons, ignition is accomplished simply by turning the match pack upside down to grip the match with the left hand and to apply pressure to the ignition finger with the right hand.

In addition to the function which ignition finger 56 has for igniting a match, it performs the function of a keeper or latch to retain cover 58 in the closed position upon insertion of the ignition finger into slot 84. Finger portion 112 will hold front cover 58 closed by frictional engagement with a wall surface of slot 84.

From the foregoing construction it will be appreciated that a match cannot be ignited without first closing cover 58 to avoid the possibility of accidentally igniting the unused matches still in the pack.

Furthermore, the danger accompanying an explosive ignition or irregular burning is avoided because the match head and a portion of the match stem are confined in chamber 80 during ignition. Body 54 thus prevents escape of potentially dangerous particles or sparks.

Finally, the match pack of this invention is virtually child-proof in that it would be exceedingly difficult for a small child to master the steps required for igniting a match.

In addition to the foregoing safety features, the match pack of this invention is simple and inexpensive to manufacture, and may be made with approximately the same dimensions as conventional match packs to make it acceptable for use in existing vending machines or the like.

Instead of forming body 54 in one piece from a plastics or other material, it may be formed from three separate sheets or pads (not shown) of suitable material which may be glued together one over the other to form a laminate body structure having separately formed top, bottom and center layers. Slot 84 would be formed in the top sheet or layer, slot 86 would be formed in the bottom sheet, and chamber 80 and passage 82 would be formed in the intermediate sheet. Alternatively, a single sheet of foldable material (not shown) could be employed, to define the top, bottom and intermediate layers mentioned above by folding the single sheet over onto itself after the necessary slots are formed in it.

The embodiment of FIGS. 11-17 illustrate the manner in which a standard safety match pack 129 may be modified to incorporate the principles of this invention. To the extent that this embodiment is the same as the one shown in FIGS. 1–10, like reference numerals have been applied to designate like parts.

In addition to match combs 52 and 53 the standard match pack as shown in FIG. 17 comprises a conventional cover **50*a* having the usual relatively foldable front and back cover portions 58*a* and 60*a* and a retaining flap 130. Flap 130 is folded over the lower region of back cover 60*a*. The bases 70 of match combs 52 and 53 are sandwiched between flap 130 and back cover 60*a*** in the usual fashion. This conventional match pack construction is modified in a number of respects to incorporate the principles of this invention.

First, aligned rectangular slots 132, 133 and 134 of the same dimensions are respectively cut through retaining flap 130, bases 70 and back cover 60*a* as shown in FIGS. 13, 14, 15 and 17. Second, the staple or other fastening element 136, which is normally located in the region of slots 132–134, is raised so that it is located between the free upper edge of flap 130 and slots 132–134. Staple 136 extends through flap 130, bases 70 and back cover 60*a* to fixed match combs 52 and 53 to the match pack cover. Slots 132–134 are elongated in the direction shown.

In addition to the foregoing modifications, an ignition chamber cover or member 140 and a combination ignition finger and keeper 56*a* are added to complete the assembly of the modified match pack.

As shown in FIGS. 11–16, member 140 may be formed or molded from a suitable plastics material to provide a firm, preferably rigid one-piece structure. Alternatively, member may be formed from any other suitable material which provides a firm construction.

Member 140 is formed with generally U-shaped configuration cross section to provide a pair of generally parallel leg portions 141 and 142 and a cross portion 143 which integrally joins leg portions 141 and 142 together.

Portions 141–143 define a channel 144 (see FIG. 16) which is open along the top and both ends to receive the lower portion of match pack 129. Thus, the lower portion of pack 129 in which slots 132–134 are formed fit in channel 144 snugly between leg portions 141 and 142. The bottom edge or wall portion of cover 50*a* preferably seats on cross portion 143 as shown. Member 140 is fixed to flap 130 and back cover 60*a* by adhesive or other suitable means.

A rectangular, elongated slot 146 for receiving finger 56*a* is formed through leg portion 141 and aligns and registers with slots 132–134. The length of slot 146 may be the same as that of slots 132–134. Slot 146, however, is significantly narrower than slots 132–134 and narrower than the width and thickness of match head 100 to prevent insertion of a match head into the ignition chamber which is indicated at 150.

As shown, ignition chamber 150 is formed or defined by the interior wall side and end surfaces of slots 132–134 and by the opposed, inwardly facing wall surfaces of leg portions 141 and 142. The interior top and bottom wall surfaces of chamber 150 are respectively defined by leg portion 141 and leg portion 142. The interior side and end wall surfaces of chamber 150 are defined by the straight wall surfaces of slots 130–132. Chamber 150 is rectangular as shown.

Figure 16:
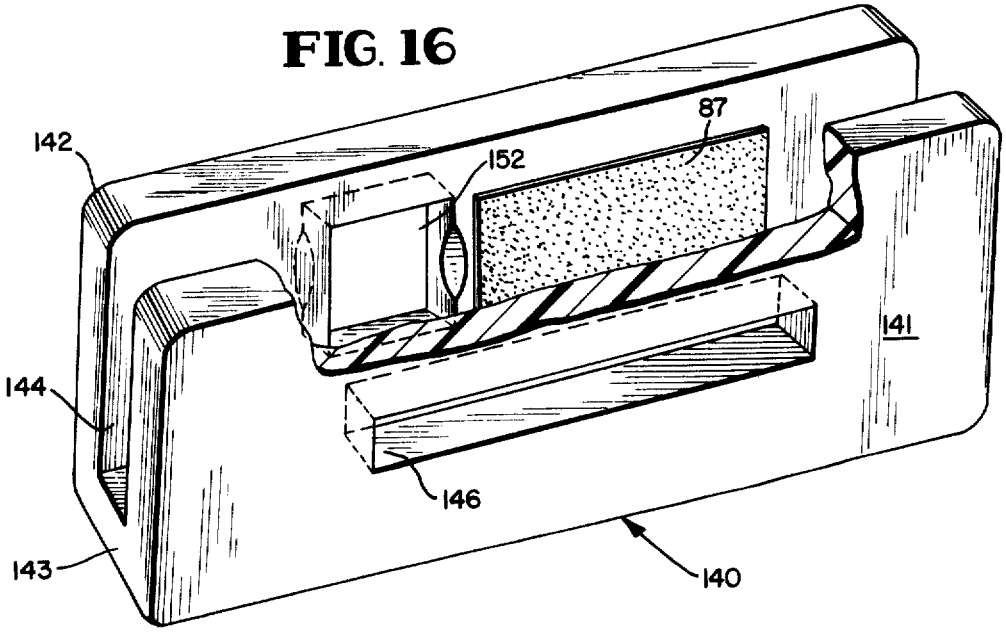
FIG. 16 is a generally perspective view of the ignition chamber member shown in FIGS. 11–15.

As best shown in FIG. 16, an entry hole or short passage 152 is formed through leg portion 142 and opens into chamber 150. As will be described shortly, a match is adapted to be inserted through the entry hole 152 to position the match head in chamber 150 for ignition.

Entry hole 152, which is a short straight passage, is offset from the center of chamber 150 and is adjacent to the right-hand end wall of chamber 150 as viewed from FIGS. 13 and 14. Entry hole 152 may be square as shown or rectangular. As viewed from FIGS. 13 and 14, the outer right-hand edge surface and the inner left-hand edge surface of hole 152 are rounded to provide smooth guiding surfaces which are contacted by the match stem as it is advanced into and removed from chamber 150. Hole 152 is positioned to one side of a plane extending parallel to the side edges of cover 58*a* and medially intersecting the front and back cover portions 58*a* and 60*a*. In this embodiment, chamber 150 and ignition finger 56*a* and medially intersected by the plane mentioned above.

The strip 106 providing surface 87 is fixed by adhesive or other suitable means to the inner surface of leg portion 142 within chamber 150. Ignition surface 87 extends between entry hole 152 and the interior left-hand end wall of chamber 150 as viewed from FIGS. 13 and 14.

Similar to ignition finger 56, finger 56*a* is L-shaped in configuration and has a body portion 110*a* and a finger 112*a*. Body portion 110*a* is fixed to the outer surface of the front cover portion 58*a* by adhesive or other suitable means. Finger portion 112*a* depends perpendicularly from body portion 110*a* and over the bottom edge of cover portion 58*a* as shown.

Finger portion 56*a* is essentially of the same construction as finger portion 56 and may be formed as one-piece from a suitable plastics material. As shown, finger portion 112*a* is positioned so that it is in alignment with and extends through slot 146 into chamber upon closing cover portion 58*a*.

The heights of finger portion 112*a* and chamber 150 are such that when cover portion 58*a* is closed as shown in FIG. 14, the straight bottom edge of finger portion 112*a* seats against the head 100 an inserted match and presses it firmly against striking surface 87. The dimension of surface 87 between the left hand end wall of chamber 150 (as viewed from FIG. 14) and entry hole 152 and the length of finger portion 112*a* (as well as finger portion 112 in the first embodiment) are long enough to assure ignition of an inserted match as it is withdrawn from chamber 150.

To ignite a match with the embodiment shown in FIGS. 11–17, the match upon being removed from the pack is inserted head first through entry hole 152 and into chamber 150 before closing cover portion 58*a* as shown in FIG. 13. The match is inserted to its fullest extent where the match head butts against the straight left hand end wall of chamber 150 as viewed from FIG. 13. The dimension of chamber 150 between its interior left-hand end wall surface (as viewed from FIG. 13) and entry hole 152 is sufficiently smaller than the length of the match being used so that when the match is inserted into chamber 150 to its fullest extent as shown in FIG. 13, a grippable end portion of the match stem remains outside of chamber 150.

Because of the location of entry hole 152, the match enters chamber 150 at an acute angle to the chamber's bottom wall surface on which surface 87 is positioned and will advance toward the upper left-hand corner of chamber 150 as seen from FIG. 13. Thus, because of this entry angle, the match head 100 is spaced from and cannot contact ignition surface 87 until finger portion 112*a* is inserted into the ignition chamber by closing cover portion 58*a*.

After inserting the match in the manner just described, cover portion 58*a* is closed to insert finger portion 112*a* through slot 146 and into chamber 150 to a position where it contacts the match head 100 and presses it firmly against ignition surface 87 as shown in FIG. 14. Engagement of match head 100 with finger portion 112*a* bends the match stem around the rounded edge surface 156 of entry hole 152.

After closing cover portion 58*a*, the ignition finger is held firmly against match head 100 by applying moderate pressure with one hand, and the match is withdrawn rapidly from chamber 150 with the other hand to effect ignition of the match by sliding it along surface 87 in essentially the same manner described for the first embodiment.

Like ignition finger 56, ignition finger 56*a* also performs of the function of a keeper to retain front cover 58*a* in its closed position by frictional engagement of finger portion 112*a* with a surface of slot 84.

From the foregoing description it will be appreciated that the embodiment shown in FIGS. 11–17 provides the same safety measures as the first embodiment. In both embodiments, striking surface 87 (which is the only one on the pack) is confined in the ignition chamber and hence is not exteriorly exposed on an exterior surface of the pack. Furthermore, both embodiments require the same manipulative steps which are exceedingly difficult for a child to master for igniting a match. Finally, in both embodiments, the ignition takes place in the ignition chamber and the front cover must be closed before ignition can be effected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

For example, passage 82 may be extended all the way through body 54 to permit insertion of a match from either end of body 54. Also, the location of the ignition chamber in each embodiment may be altered. Additionally, a second entry hole could be formed in leg portion 142 adjacent to the left hand end of chamber 150 as viewed from FIG. 14. Also, the material employed to form body 54 and member 140 may be somewhat flexible or deformable to give under pressure applied by the user and to thereby press the inserted match head against the ignition surface without requiring the use of an ignition finger such as the ones indicated at 56 and 56*a*.

Furthermore, the entry passages or holes for the match may be altered as well as the position and configuration of the ignition fingers.

Additionally, the match inserted into the ignition chamber could remain in place in its initial inserted position, and the chamber wall supporting the ignition could be made flexible to be moved by the user into contact with the match head.

What is claimed and desired to be secured by Letters Patent is:

1. In a safety match pack, having a cover formed with a back cover portion and a front cover portion folded over the back cover portion and a group of matches arranged between said front and back cover portions and attached to said cover, said front cover portion being selectively displaceable between a raised position to provide access to the matches in said group and closed position covering said group of matches, the improvement comprising means fixed to said cover to provide an ignition chamber on said cover, means providing a striking surface in said chamber, said chamber-providing means defining a hole opening into said chamber to provide for the partial head-first entry of a match to be ignited into said chamber, and said chamber providing means further being formed with a slot opening at its inner end into said chamber, and a member fixed to said front cover portion and located to extend through said slot and into said chamber to engage and press the match head in said chamber against said striking surface upon displacement of said front cover portion to said closed position to effect ignition of the match as the match is withdrawn from said chamber.

2. The safety match pack defined in claim 1 wherein said member is engageable with a wall surface of said slot to retain said front cover portion in said closed position.

3. The safety match pack defined in claim 1 wherein said slot is sufficiently narrow to prevent said match from being inserted head first into said chamber through said slot.

4. In a safety match pack, having a cover formed with a back cover portion and a front cover portion folded over the back cover portion and a group of matches arranged between said front and back cover portions and attached to said cover, said front cover portion being selectively displacable between a raised position to provide access to the matches in said group and a closed position covering said group of matches, the improvement comprising an ignition chamber positioned on said cover composed of a body formed separately of said cover and fixed to the back cover portion, a passageway formed in said body and opening at its outer end at an outer wall surface of said body to provide for the partial head first insertion of a match to be ignited into the chamber, a striking surface in the chamber offset from the line of entry of a match in the said chamber by way of said passage, a slot in said body opening into said chamber, and a means for effecting contact between the striking surface and the match head in the chamber comprising a member affixed to said front cover portion and located to extend through said slot to engage and press the match head into the chamber against said striking surface upon selectively displacing the front cover portion to the closed position.

5. A safety match pack defined in claim 4 wherein said body is fixed to the inside face of said back cover portion along the lower region of said back cover portion below said group of matches.

6. The safety match pack defined in claim 4 wherein said body is formed with a further slot which defines a portion of the chamber and which opens at its outer end at the back cover portion, wherein said back cover portion covers said further slot and wherein said striking surface is formed on a strip which is fixed to the inside face of the back cover portion and which is in registry with said further slot.

7. The safety match pack defined in claim 4 wherein said cover has a retaining flap folded over the lower region of said back portion, wherein the matches in the group are detachably joined to at least one base which is sandwiched between the flap and said back cover portion, wherein said flap, at least one base and said back cover portion are formed with aligned apertures, wherein said chamber providing means comprises a member fixed to said cover and having spaced apart leg portions, wherein said lower portion of said back cover portion, said base and said flap are confined between the legs to define said chamber in cooperation with the interior wall surface of the apertures, wherein said striking surface is formed on a strip which is fixed to one of said legs, wherein one of said legs is formed with said hole, wherein said hole opens into said chamber adjacent to said striking surface, wherein the other of said legs is formed with a slot opening into said chamber.

* * * * *